US005582219A

United States Patent [19]

Claar et al.

[11] Patent Number: 5,582,219

[45] Date of Patent: Dec. 10, 1996

[54] POLLUTION CONTROL SEALING MECHANISM FOR HOPPERS OR LIKE

[76] Inventors: Jeffrey C. Claar, 124 Cable St.; Michael S. Claar, 1415 Marlboro St., both of Sandusky, Ohio 44870

[21] Appl. No.: 94,774

[22] Filed: Jul. 21, 1993

[51] Int. Cl.[6] ..... B65B 1/30; B65B 31/00

[52] U.S. Cl. ..... 141/93; 141/114; 141/314; 141/391

[58] Field of Search ..... 141/10, 93, 114, 141/391, 390, 286, 97, 313, 314, 315, 316, 337, 388

[56] References Cited

U.S. PATENT DOCUMENTS

| | | | |
|---|---|---|---|
| 251,392 | 12/1881 | Ward | 141/392 |
| 1,894,867 | 1/1933 | Hoffman | 141/392 |
| 2,799,299 | 7/1957 | Borges | 141/313 |
| 3,241,581 | 3/1966 | Richardson et al. | 141/93 |
| 3,605,831 | 9/1971 | Mitchell et al. | 141/388 |
| 3,643,982 | 2/1972 | Murphy | 141/383 |
| 3,707,998 | 1/1973 | Dalrymple | 141/93 |
| 3,867,969 | 2/1975 | Garnett | 141/392 |
| 4,054,161 | 10/1977 | Alack | 141/312 |
| 4,182,591 | 1/1980 | Stanelle | 141/93 X |
| 4,340,136 | 7/1982 | Harrot et al. | 141/93 X |
| 4,396,045 | 8/1983 | Cain | 141/392 |
| 4,727,913 | 3/1988 | Bliss | 141/286 X |

FOREIGN PATENT DOCUMENTS

| | | | |
|---|---|---|---|
| 3613394 | 10/1987 | Germany | 141/93 |

OTHER PUBLICATIONS

Heating And Ventilating's Detail Sheet pp. 9 & 10 Jul. 1953.

*Primary Examiner*—Henry J. Recla
*Assistant Examiner*—Steven O. Douglas
*Attorney, Agent, or Firm*—Jerry W. Semer

[57] ABSTRACT

A sealing mechanism for use with open top hoppers when being field by gravity loading. The sealing mechanism has been specifically designed for the plastic industry which dumps the pellets of plastics and pigment from a mixer into an open top hopper. One embodiment is a sleeve that fits over the spout of the mixer and over the open top of the hopper. The sleeve is cut so it will fit over the spout and is sealed by a piece of tape. The bottom end of the sleeve is cut so that it will fit over the hopper and by its tensile property will fit snugly so no pigment will be lost when the mixer dumps the pigment in plastic into the hopper through the sleeve. Another embodiment is a liner that is designed to fit within a hopper with an open bottom. The liner is specifically designed so it will fit over the spout of the mixer and is sealed tightly so no pigment will be lost in the dumping process by a piece of tape. The liner is specifically designed to fit within the hopper and to fit through the open bottom of the hopper so that when the plastic is to be removed from the hopper all that is necessary is to cut or slit the bottom of the liner. The liner and sleeve are designed such that when the pigment and plastic is dumped from the mixer into the liner or through the sleeve and into the hopper no pigment will be lost thus eliminating the pollution problems and the cost of lost pigment.

17 Claims, 5 Drawing Sheets

POLLUTION CONTROL SEALING MECHANISM FOR HOPPERS OR LIKE

FIELD OF THE INVENTION

The present invention relates to a bulk handling of particulate "dusty" materials which, when discharged by gravity opening into an open top container cause clouds of dust which pollute and are harmful to persons and more particularity to a means for eliminating or minimizing the pollution and dust.

BACKGROUND OF THEE INVENTION

One of the major problems in the making of plastics is the pollution caused from the pigments used to color the plastics. When powder pigment is used it often gets into the air causing air pollution. Also these powder pigments contain heavy metal and when the dusts settles on the floor and is swept or washed down the drain or when hoppers are clean or washed and the pigment runs down the drain, heavy metals in the pigment pollute the sewage system. Further, pigment is expensive; thus the loss of this pigment is costly.

The main problem that causes this dust is when the mixer that mixes the plastic with the pigment dumps the plastic and pigment mixture into an open hopper, a great amount of the pigment is released into the air from the dumping process. This causes major problems. The first is the amount of pigment that is lost during this process cannot be calculated. Therefore, the color of the final batch cannot be adequately determined. Thus, when the color of the plastic is important the whole batch may be lost because too much of the pigment was disburse into the air during the dumping process. Secondly, this dust that is released into the air causes air pollution within the plant and raises medical and workman compensation claims of the workers in the plant. Thirdly, the cleaning up of the pigments after they have settled causes other problems. If the pigments are washed down the drain since pigments contain heavy metals, they cause water pollution. They also, because of their heavy metal content cause land fill pollution if they are disposed of in bulk. Fourthly, the loss pigment means loss money for plastics company.

To counteract this problem the plastic industrial has placed large vacuum hoses near the hopper during the pouring from the mixer. These large vacuum hoses suck up some powder. However, this powder still has to be disposed of and due to the heavy metal content of the pigments there are problems with disposal of the powder. Also, this powder that is vacuumed is lost and thus means lost of money. On the average size hopper and an average load there is approximately six dollars lost pigments per hopper.

Therefore, it is an objective of this invention to eliminate the pigment escaping into the air during the dumping process. Further, it is the objective of this invention to cut down on the amount of waste pigment so that it does not cause air pollution within a plant. Further objective of this invention to contain the powder so that it does not cause water or landfill pollution. It is also an objective of this invention to have an economical method that can control the powder and save the company's money from lost pigment.

The features of this invention are a liner or a sleeve that attaches to the mixer and attaches to or fills the hopper in such a way that when the pigment is dumped none of the pigment escape into the air but is contained by the liner. The liner's in operation costs approximately ⅓ of the cost of the lost pigment.

SUMMARY OF THE INVENTION

The invention is a sealing mechanism for use with open top hoppers when being field by gravity loading. The invention has been specifically designed for the plastic industry which dumps the pellets of plastics and pigment from a mixer into an open top hopper. One embodiment of the invention is a sleeve that fits over the spout of the mixer and over the open top of the hopper. The sleeve is cut so it will fit over the spout and is sealed by a piece of tape. The bottom end of the sleeve is cut so that it will fit over the hopper and by its tensile property will fit snugly so no pigment will be lost when the mixer dumps the pigment in plastic into the hopper through the sleeve. Another embodiment of the invention is a liner that is designed to fit within a hopper with an open bottom. The liner is specifically designed so it will fit over the spout of the mixer and is sealed tightly so no pigment will be lost in the dumping process by a piece of tape. The liner is specifically designed to fit within the hopper and to fit through the open bottom of the hopper so that when the plastic is to be removed from the hopper all that is necessary is to cut or slit the bottom of the liner. The liner and sleeve are designed such that when the pigment and plastic is dumped from the mixer into the liner or through the sleeve and into the hopper no pigment will be lost thus eliminating the pollution problems and the cost of lost pigment.

DETAILED DESCRIPTION OF THE PREFERRED EMBODIMENT

Figure 1:
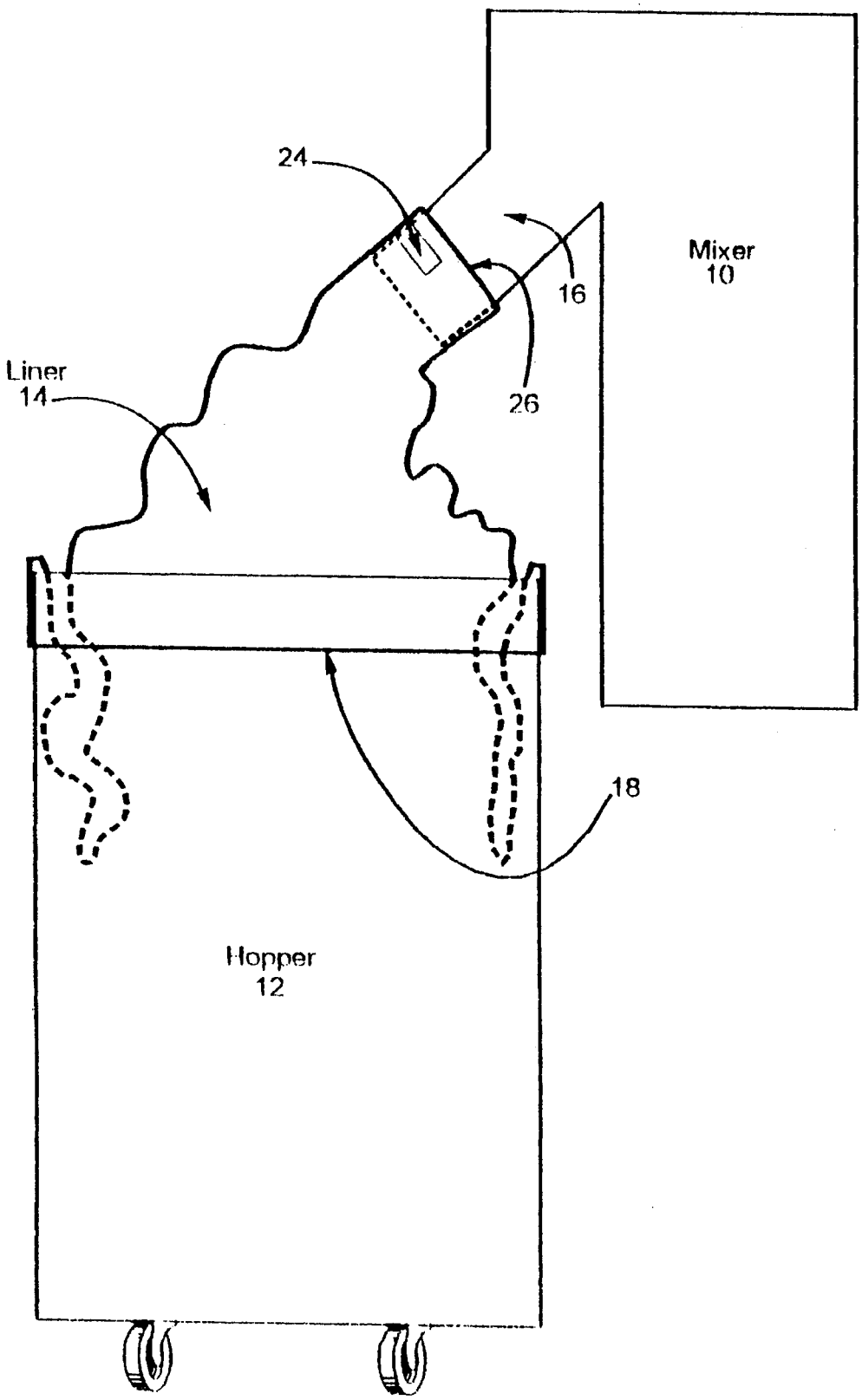
FIG. 1 is a perspective view of one embodiment of the invention.
Figure 2:
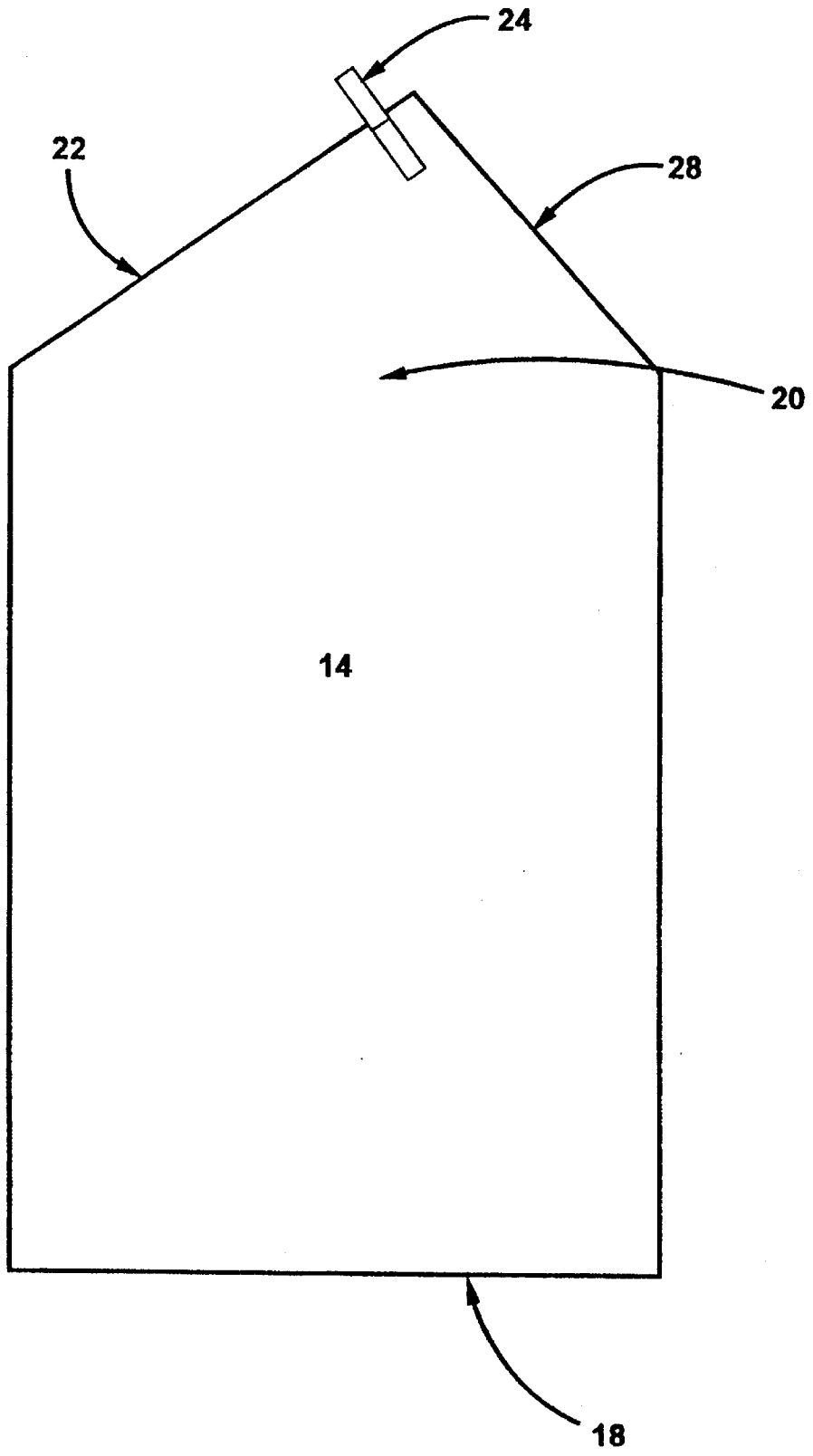
FIG. 2 is a pattern for making the invention of FIG. 1.

FIG. 1 shows the invention in use. FIG. 1 shows the mixer 10 and the hopper 12. A sleeve 14, the invention, attaches over the spout 16 of the mixer 10 and the other end of the sleeve 14 is placed over the open top of the hopper 12 forming an enclosed channel from the mixer 10 to the hopper 12. FIG. 2 shows a pattern for the sleeve 14. The sleeve 14 in the preferred embodiment is made out of sleeve stock low density polyethylene. The sleeve 14 can be either made out of a tube of polyethylene or flat pieces of polyethylene. If it is made out of a tube of polyethylene the bottom end of the sleeve 14 must be adapted to fit over the open top of the hopper 12. If it is made out of two pieces of polyethylene the sides of the pieces of polyethylene are heat sealed to make a tube. The bottom 18 formed from these two pieces also must fit over the open top of the hopper 12. In the preferred embodiment the polyethylene sleeve is cut so it will just barley fit over the hopper 12 to form a tight seal around the top of the hopper 12. In the preferred embodiment polyethylene is used due to its tensile property to form this tight seal. However, other flexible materials may be used since a tight seal can be formed around the top of the hopper by other material and other methods. The tensile property of these materials could be used to form a tight seal; however, there are various sealing methods known in the art that could also be used to make this seal. The top 20 of the sleeve 14 is cut to form a triangular. One edge 22 of the triangular top 20 is heat sealed for closure. The other edge 24 of the triangular top 20 is left open to fit over the mixer 10. In the preferred embodiment a piece of adhesive tape 24 with the die cut backing partially exposed is applied near and parallel to the opening 26 for the mixer 10 as shown in FIG. 2. Half the tape is left intact.

In used the opening 26 of the top 20 of the sleeve 14 is attached over the spout 16 of the mixer 10 and is pulled tight and sealed using adhesive tape 24. The bottom 18 of the sleeve 14 is placed around the open top of the hopper 12 with the tensile property of the polyethylene creating a tight seal around the top of the hopper 12. When the mixture of powder and plastic pellets is released into the hopper 12, this invention provides a barrier to the release of powder into the air. When the plastic and pigment are release from the mixer into the hopper 14 they displace the air already in the hopper and sleeve. Thus, the sleeve 14 has to be designed to billow out to compensate for the displacement of air. The inventors have found that in the average case by adding additional material to the sleeve to compensate for one half the volume of the hopper is sufficient to take care of this displace air. However this proportion can change based on the user process of dumping.

The preferred embodiment is made by the following method. First, two pieces of low density two mil polyethylene are used. The length of these pieces are determined by the distance between the hopper 12 and the mixer 16 and also by the formula to tell what additional material is needed for the billowing as put forth above. The width of the material is determined by the circumference of the open hopper top for which the sleeve must be placed over. When using polyethylene material the circumference of the bottom of the sleeve must be slightly less than the circumference of the open hopper 12. This is due to the fact that the tensile property of the polyethylene is being used to form a seal that does not allow any of the pigment to escape. In the preferred embodiment for an average hopper the length of the material is 42 inches and the width of the material is 38 inches. Then both pieces of materials are cut to form a triangular top 20. The edges of materials are then heat sealed as well as one edge 22 of the triangular top. The other edge 28 of the triangular top 20 that fits over the mixer's spout 16 is left open. Also the bottom which fits over the hopper 12 is left open. The mixer spout opening 26 in the preferred embodiment for an average size mixer spout is 19 inches in length forming a 38 inch circumference. Then a piece of adhesive tape 24 with a die cut backing partially exposed is applied near and parallel to the opening 26 for the mixer spout 16 as shown in FIG. 2.

Figure 3:
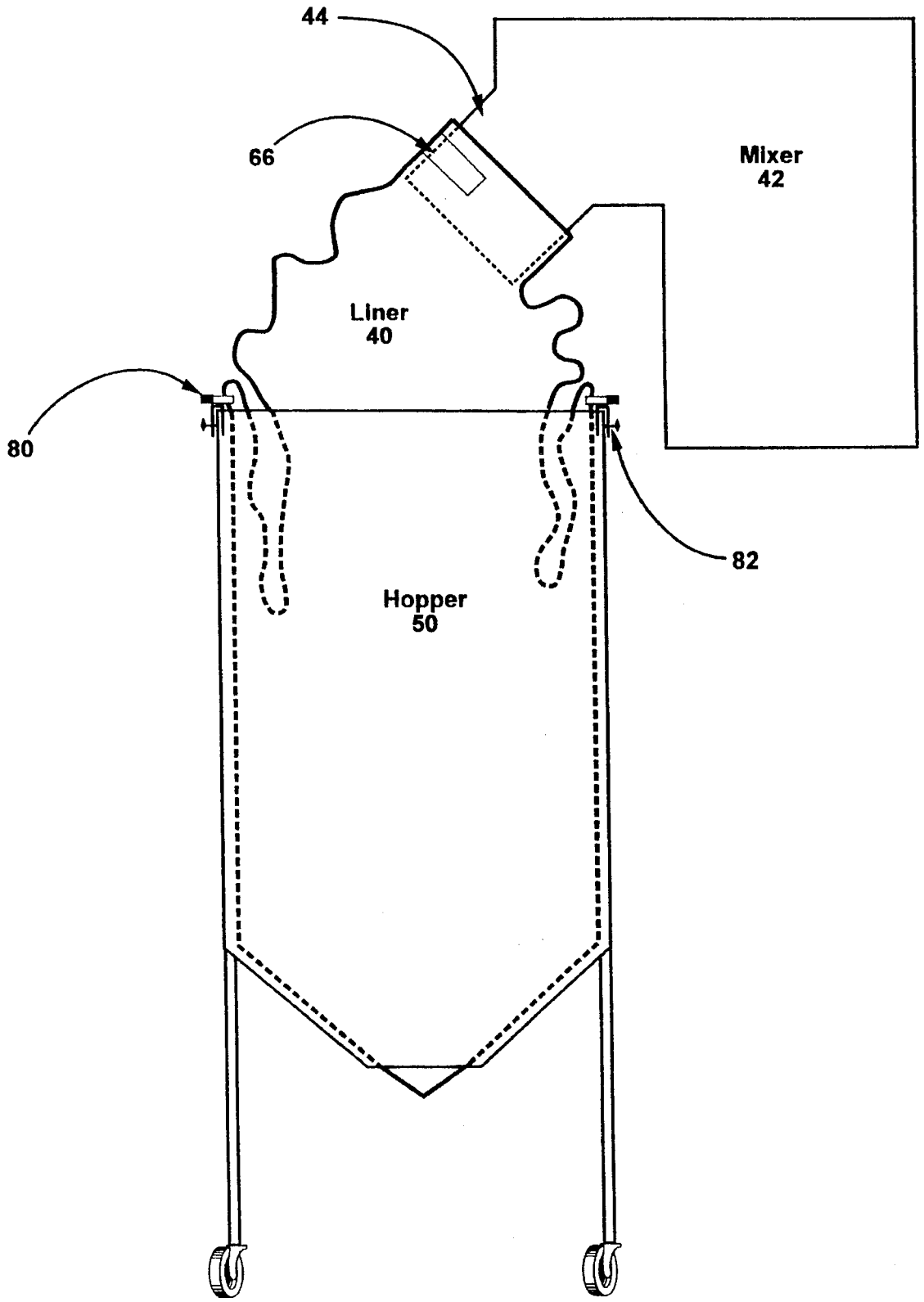
FIG. 3 is a perspective view of another embodiment of the invention when its in use with its body within the hopper in phantom.
Figure 4:
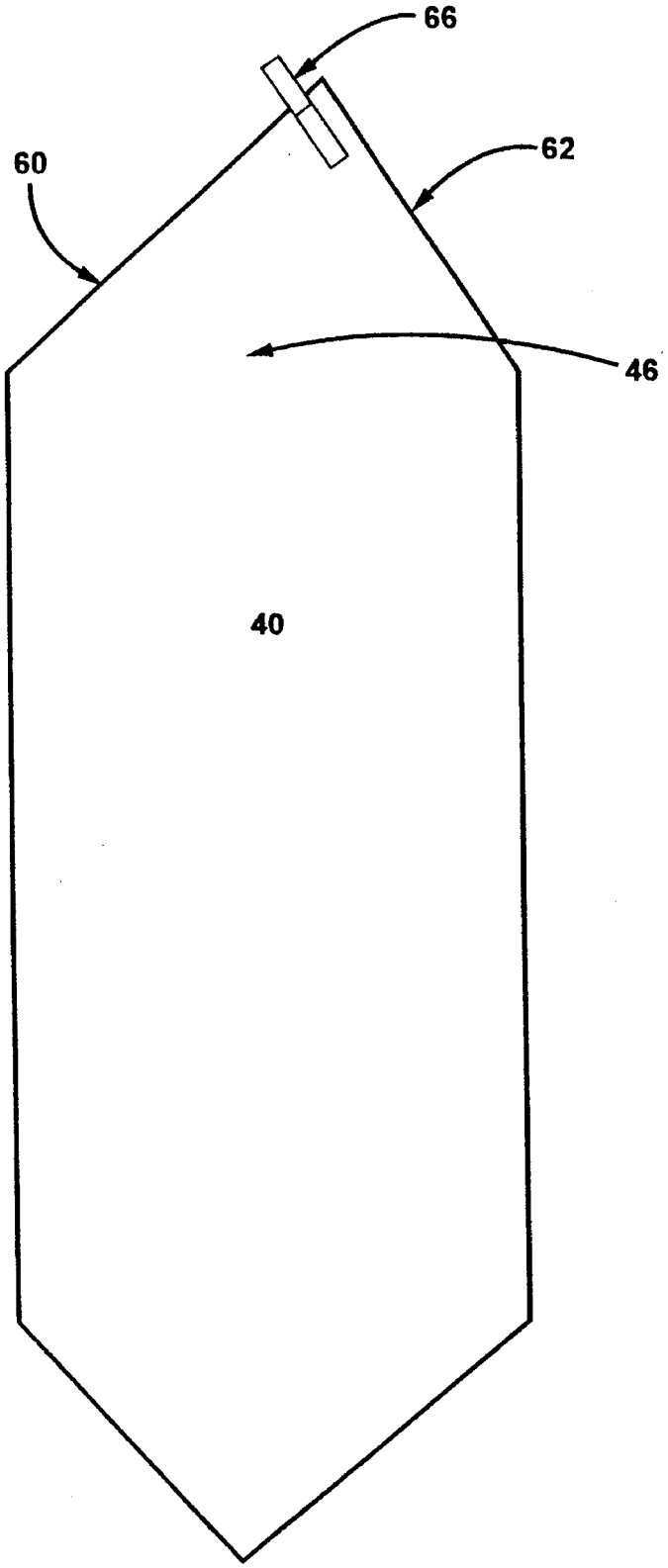
FIG. 4 is a pattern for making the invention of FIG. 3.

FIGS. 3 and 4 shows another embodiment of the invention. This embodiment of the invention fully lines the hopper 52 and is designed for hoppers that have open bottoms to allow the pigment to be dumped from the open bottom 54 of the hopper 52. FIG. 3 shows a liner 40. The liner 40 attached to the spout 44 of mixer 42 and fits within hopper 54. The liner 40 top is made the same as in the previous embodiment.

In this embodiment the liner 40 is made out of low density polyethylene sleeve material. The top of the liner 40 is cut the same as in the previous embodiment. FIG. 4 shows the pattern for the embodiment. As in the previous embodiment this liner is formed by two pieces of two mil low density polyethylene. The length of the two pieces is the distance between the hopper and the mixer and the depth of the hopper. The width is determined by the width of the hopper. The top of the liner 40 is cut triangular in shape and is designed so that one side of the triangular top 46 of the liner 40 will fit over the spout 44 of the mixer 42 that sets to the side of the hopper 50. One edge 60 of the triangular top 46 is cut and heat sealed. The other edge 62 is left open and its diameter is slightly larger than the diameter of the mixer spout 44. A piece of adhesive tape 66 with a die cut backing which is partially exposed, is applied near and parallel to this opening. The remaining half of the tape is left intact for the sealing at the point of used. The sides of the liner 40 are cut in the proper diameter to fit with hopper 50. The bottom of the liner 40 in this embodiment is also triangular in shape. The bottom needs to be cut at the proper angles to match the bottom sides of the hopper 50. These bottom angles are cut and heat sealed.

Figure 5:
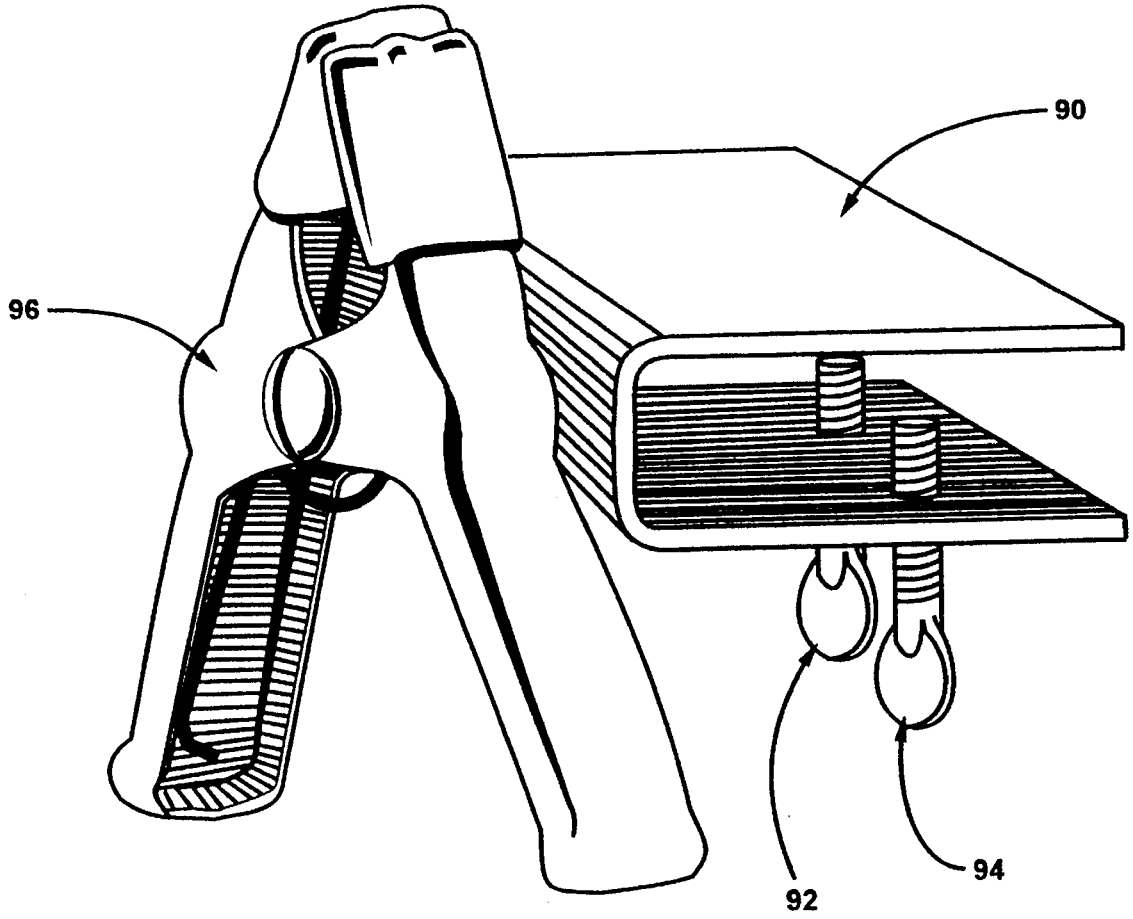
FIG. 5 is a perspective view of a clip.

In order to better hold the liner in the hopper two clip assembles 80 and 82 are used. FIG. 5 shows these clip assemblies. The clip assembly if formed by a "U" shaped bracket 90. This "U" shaped bracket is placed over the top of the hopper and is tighten down by two thumb screws 92 and 94 on one end of the "U" shaped bracket 90. On the bottom of the "U" shaped bracket a large spring loaded clamp 96 is attach by means of a screw 97 and a bolt. The clamp 96 is designed to hold the liner 40 in place during the dumping the plastic and pigment. The clip assemblies 80 and 82 are placed on the top of hopper 50 directly across from one another. The liner 40 is placed in hopper 50 such that the liner bottom will fit the bottom of the hopper and then the liner 40 is held in place by using the two clip assemblies 80 and 82. The liner 40 when placed in the hopper 50 is flat so that there is very little air within. Thus this eliminates the problem of displacement of air within the liner since there is no air to displace within the liner. The air in the hopper 50 is on the outside of the liner and thus as the pigment and plastic fills the liner 40 the air in the hopper 50 is forced out the open top of the hopper 50 by the expanding liner 40.

In the embodiment shown the hopper 50 has an opening in the bottom. In this embodiment the hopper 50 and the liner 40 after being filled at the mixer would be moved to the next position along the assembly line where the pigment and the plastic have to be removed from the hopper and the liner 40. In this case the hopper 50 would be placed over the vat to which the plastic and pigment are to be dumped and the bottom of the liner 40 that sticks through the opening would be slit or cut to allow the pigment and plastic to flow out.

These two embodiments are designed to provide a protective barrier between the mixer and hopper that does not allow any of the pigment or plastic to be disburse in the air. Thus, eliminating an air pollution problems from the dispersal of pigment and any problem as to the clean up and disposal of the pigment or plastic that escapes in the prior art when the mixture is dumped from the mixer into the hopper.

Changes and modification in this specifically described embodiment can be carried out without the departing from the scope of the invention that is intended to be limited only by the scope of claims.

What is claimed:

1. A sleeve comprising:

a. a tube adapted to guide particulate matter from an opening that discharges the particulate matter to a container adapted to hold the particulate matter and said tube has a top with an opening and said tube has a closed bottom that is adapted to fit within a container; and, b. the top of the tube is designed to fit over an opening that discharges particulate matter into the container; and, c. a means for attaching the opening at the top of the tube around the opening that discharges particulate matter; and, d. a means for compensating for the air that is displaced when the particulate matter is discharged from the opening that discharges particulate matter into the container by using additional material in the sleeve so that when the particular matter is discharged from the opening that discharges particular matter into the container the air that is displaced will cause the tube to expand its volume by billowing out the additional material and not destroy the means for attaching.

2. A a sleeve as in claim 1 wherein:

a. the first means for sealing the opening at the top of the tube around the opening that discharges particulate matter into the container comprises:

(1) a piece of adhesive tape placed near the opening in the top of the tube and in parallel to the opening; and, (2) whereby the opening in the top of the tube is placed over the opening that discharges particulate matter into the container and is pulled tight and sealed with adhesive tape.

3. A sleeve as in claim 1 further comprising:

a. a clip attached to the container and removably attached to the sleeve that holds the sleeve in placed in the container when the particulate matter is being discharged.

4. Claims a sleeve as in claim 1 wherein:

a. the additional material added to the sleeve is an amount of material that will increase the volume of the tube by one half the volume of the container.

5. A sleeve as in claim 1 wherein:

a. the tube is made out of a material that when the particulate matter is discharged from the opening that discharges particulate matter to the container no particulate matter will escape through the tube.

6. A sleeve as in claim 5 wherein:

a. the tube is made out of thin flexible plastic.

7. A sleeve as in claim 6 wherein:

a. the sleeve is made out of polyethylene material.

8. A sleeve as in claim 1 wherein:

a. the means for attaching also seals the opening at the top of the tube around the opening that discharges particulate matter and said seal is of a quality that when the particulate matter is discharged from the opening that discharges particulate matter to the container no particulate matter will escape.

9. A sleeve comprising:

a. a tube with a top with an opening and a bottom with an opening and said tube is adapted to guide particulate matter from an opening that discharges particulate matter into a container with an opening adapted to hold particulate matter; and, b. the top of the tube is design to fit over an opening that discharges particulate matter into the container; and, c. a first means for attaching the opening at the top of the tube around the opening that discharges particulate matter; and, d. a first means for sealing the opening at the top of said tube around the opening that discharges particulate matter; and, e. a second means for sealing the opening at the bottom of the tube around the container; and, f. the tube is made out of a material and said first and second sealing means are of a quality that when the particulate matter is discharged from an opening that discharges particulate matter to the container no particulate matter will escape; and, g. a means for compensating for the air that is displaced when the particulate matter is discharged from an opening that discharges particulate matter into the container and said compensating means comprises additional material in the sleeve so that when the particulate matter is discharged from the opening that discharges particulate matter into the container the air that is displaced will cause the tube to expand its volume by billowing out the additional material and not destroy the first and second means for sealing.

10. A sleeve as in claims 9 wherein:

a. the first means for sealing and the means for attaching comprising:

(1) a piece of adhesive tape attached near the opening at the top of the tube and said a piece of adhesive tape is attached parallel to said opening; and, (2) the opening at the top of the tube is placed over the opening that discharges particulate matter into the container and is pulled tight around the opening discharging particulate matter into the container and is sealed by an adhesive tape.

11. A sleeve as in claim 9 wherein:

a. the tube has a closed bottom that is adapted to fit within a container.

12. A sleeve as in claim 9 wherein:

a. the tube is made out of thin flexible plastic.

13. A sleeve as in claim 12 wherein:

a. the tube is made out of polyethylene.

14. A sleeve as in claim 13 wherein:

a. the second sealing means is by stretching the bottom of the polyethylene tube around the opening of the container.

15. A sleeve as in claim 9 wherein:

a. the additional material added to the tube is an amount of material that will increase the volume of the tube by one half the volume of the container.

16. A sleeve as in claim 9 wherein:

a. the tube is made out of thin flexible plastic.

17. A sleeve comprising:

a. a tube adapted to guide particulate matter from an opening that discharges particulate matter to a container with an opening adapted to hold particulate matter and said tube has a top with an opening and said tube has a closed bottom that is adapted to fit within the container with an opening; and, b. the top of the tube is designed to fit over the opening that discharges particulate matter into the container; and, c. a means for attaching the opening at the top of said tube around the opening that discharges particulate matter; and, d. a means for compensating for air that is displaced when the particulate matter is discharged from the opening that discharges particulate matter into the container and said compensating means is by using additional material in the sleeve and attaching the tube to the means that discharges particulate matter and placing the tube within the container such that when the particulate matter is discharged from the means for discharging particulate matter into the tube within the container the discharged air expands the volume of the tube and drives air within the tube out through the opening at the top of said tube.

* * * * *